US010914172B2

(12) United States Patent
Achten

(10) Patent No.: US 10,914,172 B2
(45) Date of Patent: Feb. 9, 2021

(54) HYDRAULIC DEVICE

(71) Applicant: INNAS BV, Breda (NL)

(72) Inventor: Peter Augustinus Johannes Achten, Eindhoven (NL)

(73) Assignee: INNAS BV, Breda (NL)

( * ) Notice: Subject to any disclaimer, the term of this patent is extended or adjusted under 35 U.S.C. 154(b) by 0 days.

(21) Appl. No.: 16/099,356

(22) PCT Filed: May 17, 2017

(86) PCT No.: PCT/EP2017/061851
§ 371 (c)(1),
(2) Date: Nov. 6, 2018

(87) PCT Pub. No.: WO2017/198718
PCT Pub. Date: Nov. 23, 2017

(65) Prior Publication Data

US 2019/0211811 A1 Jul. 11, 2019

(30) Foreign Application Priority Data

May 19, 2016 (EP) ..... 16170442

(51) Int. Cl.
*F01B 3/00* (2006.01)

(52) U.S. Cl.
CPC ..... *F01B 3/0052* (2013.01)

(58) Field of Classification Search
CPC ..... F01B 3/0052; F03C 1/0652; F04B 1/2035
See application file for complete search history.

(56) References Cited

U.S. PATENT DOCUMENTS 3,434,429 A 3/1969 Goodwin
3,648,567 A 3/1972 Clark
(Continued)

FOREIGN PATENT DOCUMENTS

CN 101313148 A 11/2008
CN 101523052 A 9/2009
(Continued)

OTHER PUBLICATIONS

International Search Report, dated Aug. 8, 2017 for corresponding International Patent Application No. PCT/EP2017/061851, filed May 17, 2017.
(Continued)

*Primary Examiner* — F Daniel Lopez
(74) *Attorney, Agent, or Firm* — Steven M. Koehler; Westman, Champlin & Koehler, P.A.

(57) ABSTRACT

A hydraulic device comprises a shaft mounted in a housing rotatable about a first axis. A plurality of pistons are fixed to a flange rotatable about a first axis. A plurality of cylindrical sleeves sleeve bottoms and sleeve jackets that cooperate with the pistons to form compression chambers. Rotation of the shaft causes the volumes of the compression chambers. Each piston head forms a sealing line within the cooperating sleeve jacket. Each sleeve jacket has a thin wall and/or is elastically movable with respect to the sleeve bottom such that at a fixed pressure the radial deformation of the sleeve jacket at the sealing line is substantially constant at piston positions ranging from bottom dead center to a position where the distance between the sleeve bottom and the sealing line is less than 50% of the distance between the sleeve bottom and the sealing line at bottom dead center.

15 Claims, 2 Drawing Sheets

(56) References Cited

U.S. PATENT DOCUMENTS

| | | | | |
|---|---|---|---|---|
| 3,948,111 | A | 4/1976 | Dittrich | |
| 3,958,456 | A | 5/1976 | Jacobson | |
| 4,223,594 | A | 9/1980 | Gherner | |
| 4,361,077 | A | 11/1982 | Mills | |
| 4,703,682 | A | 11/1987 | Hansen | |
| 4,776,257 | A | 10/1988 | Hansen | |
| 5,249,506 | A | 10/1993 | Willimczik | |
| 5,415,530 | A | 5/1995 | Shilling | |
| 5,636,561 | A | 6/1997 | Pecorari | |
| 5,794,514 | A | 6/1998 | Pecorari | |
| 5,778,757 | A | 7/1998 | Kristensen et al. | |
| 5,960,697 | A | 10/1999 | Hayase et al. | |
| 6,283,721 | B1 | 9/2001 | Gollner | |
| 6,293,768 | B1 | 9/2001 | Shintoku et al. | |
| 6,312,231 | B1 | 11/2001 | Kuhne et al. | |
| 6,629,822 | B2 | 10/2003 | Larkin et al. | |
| 6,663,354 | B2 | 12/2003 | Forster | |
| 6,802,244 | B1 * | 10/2004 | Stoppek ..... | F01B 3/002 29/888.02 |
| 7,311,034 | B2 | 12/2007 | Achten | |
| 7,328,647 | B2 | 2/2008 | Achten | |
| 7,470,116 | B2 | 12/2008 | Dantlgraber | |
| 7,731,485 | B2 | 6/2010 | Achten | |
| 8,794,938 | B2 | 8/2014 | Frey | |
| 2005/0017573 | A1 | 1/2005 | Achten | |
| 2005/0019171 | A1 | 1/2005 | Achten | |
| 2005/0201879 | A1 | 9/2005 | Achten | |
| 2006/0051223 | A1 | 3/2006 | Mark et al. | |
| 2006/0120881 | A1 | 6/2006 | Dantlgraber | |
| 2006/0222516 | A1 | 10/2006 | Achten | |
| 2007/0251378 | A1 | 11/2007 | Nelson | |
| 2009/0007773 | A1 | 1/2009 | Zhu | |
| 2009/0084258 | A1 | 4/2009 | Stoezer | |
| 2009/0196768 | A1 | 8/2009 | Nelson et al. | |
| 2009/0290996 | A1 | 11/2009 | Ishizaki | |
| 2010/0119394 | A1 | 5/2010 | Frey | |

FOREIGN PATENT DOCUMENTS

| | | | |
|---|---|---|---|
| DE | 2130514 | A1 | 12/1972 |
| DE | 3519783 | A1 | 12/1986 |
| DE | 102006021570 | A1 | 10/2007 |
| DE | 102008012404 | A1 | 9/2009 |
| EP | 1508694 | A1 | 2/2005 |
| EP | 1855002 | A1 | 11/2007 |
| EP | 2012010 | A1 | 1/2009 |
| GB | 2446348 | A | 8/2008 |
| JP | 2005514552 | A | 5/2005 |
| JP | 2005522631 | A | 7/2005 |
| JP | 2009531590 | A | 9/2009 |
| NL | 1019736 | C1 | 7/2003 |
| NL | 1020932 | C2 | 7/2003 |
| WO | 8600662 | A1 | 1/1986 |
| WO | 2003058035 | A1 | 7/2003 |
| WO | 2004055369 | A1 | 7/2004 |
| WO | 2006083163 | A1 | 8/2006 |
| WO | 2007060822 | A1 | 5/2009 |

OTHER PUBLICATIONS

Written Opinion of the International Searching Authority, dated Aug. 8, 2017 for corresponding International Patent Application No. PCT/EP2017/061851, filed May 17, 2017.

"Volumetric losses of a multi piston floating cup pump", Peter A.J. Achten; Proceedings of the National Conference on Fluid Power; 337-348; Proceedings of the 50th National conference on fluid power by National Fluid Power Association; 2005, NCFP I05-10.2.

U.S. Appl. No. 16/099,366, filed Nov. 6, 2018.

U.S. Appl. No. 16/099,369, filed Nov. 6, 2018.

* cited by examiner

HYDRAULIC DEVICE

CROSS-REFERENCE TO RELATED APPLICATION

The present application is a national stage of and claims priority of International patent application Serial No. PCT/EP2017/061851, filed May 17, 2017, and published in English as WO/2017/198718.

BACKGROUND

The present invention relates to a hydraulic device comprising a housing having a shaft which is mounted in the housing and rotatable about a first axis of rotation. The shaft has a flange extending transversely to the first axis. A plurality of pistons is fixed to the flange at equiangular distance about the first axis of rotation. A plurality of cylindrical sleeves having sleeve bottoms and sleeve jackets, respectively, cooperate with the pistons to form respective compression chambers of variable volume. The cylindrical sleeves are rotatable about a second axis of rotation which intersects the first axis of rotation by an acute angle such that upon rotating the shaft the volumes of the compression chambers change between bottom dead center and top dead center of the pistons within the sleeves. Each piston has a piston head including a circumferential wall of which the outer side is ball-shaped, hence forming a sealing line within the cooperating sleeve jacket, where the inner side surrounds a cavity.

In the afore-mentioned device, the radial deformation of the sleeve jacket depends on the depth that the piston is inserted in the sleeve, but the radial expansion at the sealing line can almost be constant at different positions of the piston within the sleeve. Furthermore, the asymmetric hydrostatic load on the outer side of the piston head, the thin-wailed piston head deforms to an oval shape during the compression phase, i.e. when the distance between the piston head and the sleeve bottom decreases. Under operating conditions the piston expansion more or less follows the piston sleeve expansion during the compression phase. Consequently, leakage flow between the piston head and the sleeve jacket at the sealing line is minimized.

Since the sleeve bottom causes increased stiffness or a portion of the sleeve jacket which is adjacent to the sleeve bottom, radial deformation of the sleeve jacket at the sealing line decreases when the distance between the sleeve bottom and the piston head becomes smaller. As a consequence, the piston and sleeve jacket may scratch each other near the sleeve bottom, i.e. when top dead center lies close to the sleeve bottom. For this reason the dimensions of the pistons and cooperating sleeves are matched on the basis of the critical condition when the piston head and the sleeve bottom approach each other.

SUMMARY

An aspect of the invention is to provide a hydraulic device with tight tolerances between the pistons and the cooperating sleeves whereas minimizing the risk of scratching between the piston heads and the sleeve jackets.

In an embodiment of a hydraulic device, each sleeve jacket has such a thin wall and/or is elastically movable with respect to the sleeve bottom such that at a fixed pressure in the compression chamber the radial deformation of the sleeve jacket at the sealing line is substantially constant at piston positions ranging from bottom dead center to a position where the distance between the sleeve bottom and the sealing line is less than 50% of the distance between the sleeve bottom and the sealing line at bottom dead center.

Due to a relatively thin wall of the sleeve jacket its stiffness is also relatively low such that the radial deformation at the sealing line remains substantially constant at a fixed pressure in the compression chamber at different positions of the piston in the direction from bottom dead center to top dead center over a relatively long distance. A similar effect is achieved when the sleeve jacket is elastically movable in radial direction with respect to the sleeve bottom. This means that the risk of contact between the piston head and the sleeve jacket upon approaching the sleeve bottom is relatively low. Furthermore, the relatively small stiffness allows a relatively tight tolerance between the piston head and the sleeve jacket near top dead center. Even if the piston head tends to contact the sleeve jacket, the sleeve jacket may be deformed and/or moved with respect to the sleeve bottom by the piston head at a relatively low force. In that case the piston may deform to a less oval shape and the sleeve jacket may deform to a more oval shape. It is noted that the radial deformation of the sleeve jacket between the sleeve bottom and the sealing line may be relatively large due to the small stiffness, but that is not relevant since it is the radial deformation at the sealing line which dictates leakage flow and not the radial deformation between the sleeve bottom and the sealing line. It is noted that the sleeve can be a single part.

An additional advantage of a relatively thin wall of the sleeve jacket is a relatively low weight of the sleeve. Particularly, for hydraulic devices which are operated at high rotational speed centrifugal forces on the sleeves are minimized causing reduced tendency of the sleeves to tilt with respect to a barrel place by which they are supported.

It is noted that the term substantially constant may be defined as varying between ±10% or ±5% of the average value.

The radial deformation may be substantially constant to a position where the distance between the sleeve bottom and the sealing line is less than 40% of the distance between the sleeve bottom and the sealing line at bottom dead center.

The distance between the sleeve bottom and the sealing line at top dead center may be smaller than 30% of the distance between the sleeve bottom and the sealing line at bottom dead center. This means that the sealing line at top dead center may lie close to the sleeve bottom. When using a sleeve jacket of a larger wall thickness the distance between the sleeve bottom and cop dead center might be increased to achieve a comparable constant radial deformation profile over a long distance from bottom dead center, but this leads to a larger dead volume between the sleeve bottom and top dead center. This would be disadvantageous in terms of efficiency and noise emission.

In practice the sleeve may be made of steel whereas the wall thickness of the sleeve jacket can be smaller than 1.5 mm. For example, the sleeve jacket may have a wall thickness of 1.1 mm and an inner diameter of 11.8 mm, whereas the sleeve length may be 15 mm.

In more general terms, the wall thickness of the sleeve jacket may be smaller than 13% of the outer diameter of the sleeve jacket and/or smaller than 13% of the length of the sleeve jacket. For example, the wall thickness of the sleeve jacket lies within the range of 5-13% of the outer diameter of the sleeve jacket, or possibly within the range of 8-12% thereof.

The sleeve jacket can be elastically movable with respect to the sleeve bottom when the sleeve has a locally reduced wall thickness at the transition between the sleeve jacket and the sleeve bottom. In this case the sleeve jacket does not necessarily have an extremely thin wall. In fact, the locally reduced wall thickness functions as an elastic pivot between the sleeve jacket and the sleeve bottom.

The locally reduced wall thickness may be located in the sleeve jacket and may be formed, for example, by opposite circumferential recesses located at the inner side and outer side of the sleeve jacket.

Alternatively, the locally reduced wall thickness may be located in the sleeve bottom and may be formed, for example, by a circumferential recess located at the inner side of the sleeve.

It is noted that the angle between the first axis of rotation and the second axis of rotation may have a maximum value of 8-15'.

BRIEF DESCRIPTION OF THE DRAWINGS

Aspects of the invention will hereafter be elucidated with reference to very schematic drawings showing embodiments of the invention by way of example.

DETAILED DESCRIPTION

Figure 1:
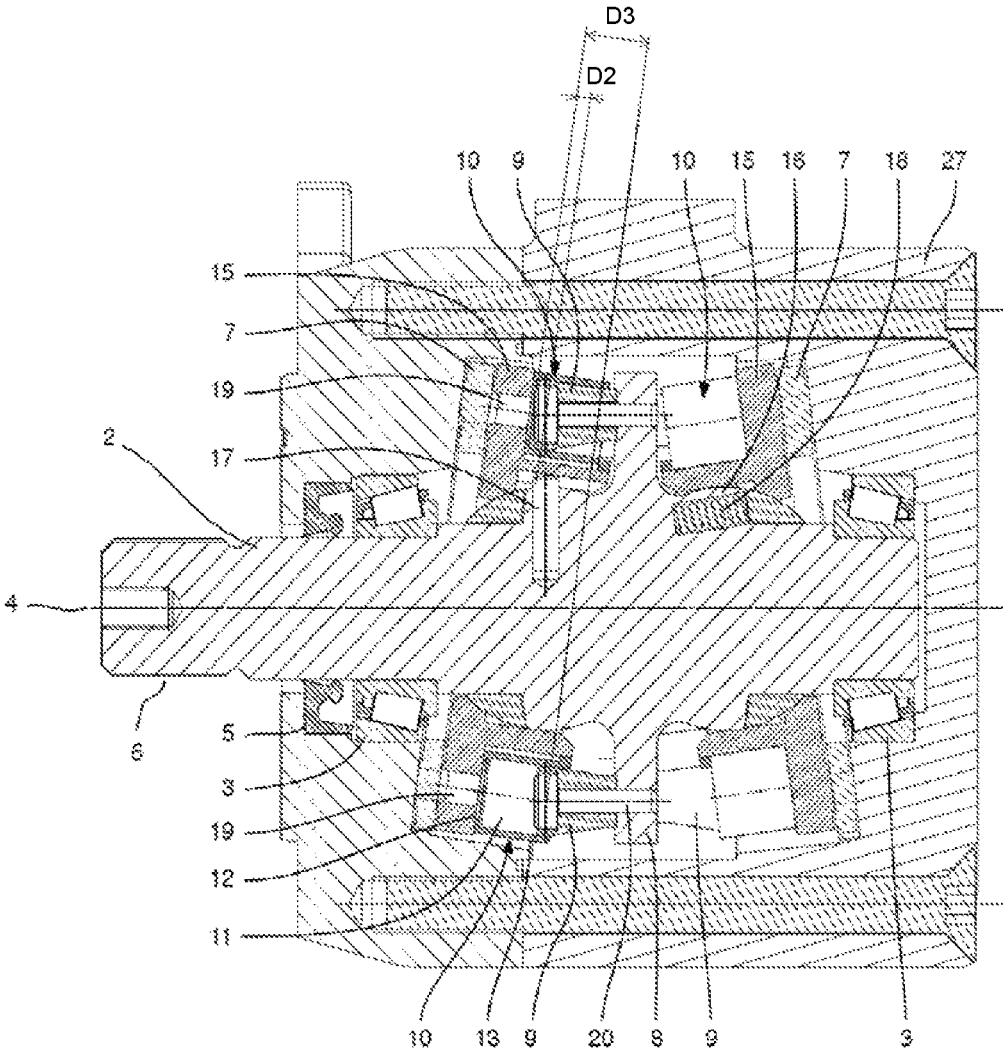
FIG. 1 is a cross-sectional view of an embodiment of a hydraulic device.

FIG. 1 shows internal parts of a hydraulic device 1, such as a pump or hydromotor, which are fitted into a housing 27 in a known manner. The hydraulic device 1 is provided with a shaft 2 which is supported by bearings 3 at both sides of the housing 27 and it is rotatable about a first axis of rotation 4. The housing 27 is provided on the one side with an opening with a shaft seal 5 in a known manner, as a result of which the end of the shaft 2, which is provided with a toothed shaft end 6, protrudes from the housing 27. A motor can be coupled to the toothed shaft end 6 if the hydraulic device 1 is a pump, and a driven tool can be coupled thereto if the hydraulic device 1 is a motor.

The hydraulic device 1 comprises face plates 7 which are mounted inside the housing 27 at a distance from each other. The face plates 7 have a fixed position with respect to the housing 27 in rotational direction thereof. The shaft 2 extends through central through-holes in the face plates 7.

The shaft 2 is provided with a flange 8 which extends perpendicularly to the first axis of rotation 4. A plurality of pistons 9 are fixed at both sides of the flange 8 at equiangular distance about the first axis of rotation 4, in this case fourteen pistons 9 on either side. The pistons 9 have center lines which extend parallel to the first axis of rotation 4. The planes of the face plates 7 are angled with respect to each other and with respect to the plane of the flange 8.

Figure 2:
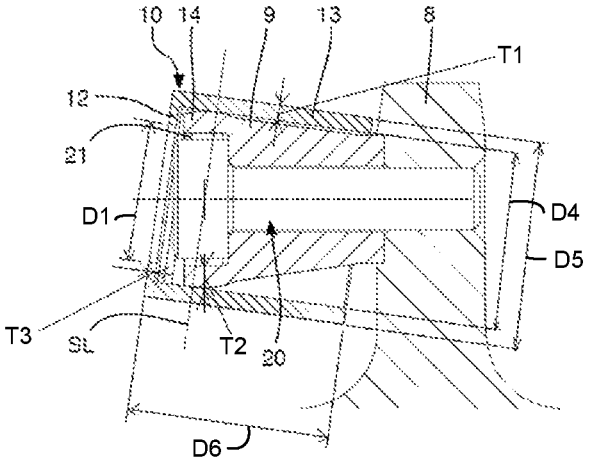
FIG. 2 is a cross-sectional view of a part of the embodiment of FIG. 1 on a larger scale.

Each of the pistons 9 cooperates with a cylindrical sleeve 10 to form a compression chamber 11 of variable volume. The hydraulic device 1 as shown in FIG. 1 has 28 compression chambers 11. The cylindrical sleeve 10 comprises a sleeve bottom 12 and a sleeve jacket 13. Each piston 9 is sealed directly to the inner wall of the sleeve jacket 13 through a ball-shaped piston head 14. FIG. 2 shows one piston 9 including the piston head 14 and a sleeve 10 of the hydraulic device 1 on a larger scale.

The sleeve bottoms 12 of the respective cylindrical sleeves 10 are supported by respective barrel plates 15 which are fitted around the shaft 2 by means of respective ball hinges 16 and are coupled to the shaft 2 by means of keys 17. Consequently, the barrel plates 15 rotate together with the shaft 2 under operating conditions. The barrel plates 15 rotate about respective second axes which are angled with respect to the first axis of rotation 4. This means that the cylindrical sleeves 10 also rotate about the respective second axes of rotation. As a consequence, upon rotating the shaft 2 the volumes of the compression chambers 11 change. During rotation of the barrel plates 15 each cylindrical sleeve 10 makes a combined translating and swiveling motion around the cooperating piston 9. Therefore, the outer side of each piston head 14 is ball-shaped. The ball-shape creates a sealing line between the piston 9 and the sleeve jacket 13. FIG. 2 shows the location of the sealing line by means of a plane it, which extends parallel to the sleeve bottom 12. The pistons 9 are conical and their diameters decrease towards the flange 8 in order to allow the relative motion of the cooperating cylindrical sleeves 10 about the pistons 9.

The sides of the respective barrel plates 7 which are directed away from the flange 8 are supported by respective supporting surfaces of the face plates 7. Due to the inclined orientation of the supporting surfaces of the face plates 7 with respect to the flange 8 the barrel plates 15 pivot about the ball hinges 16 during rotation with the shaft 2. The angle between the first axis of rotation 4 and the respective second axes of rotation is approximately nine degrees in practice, but may be smaller or larger.

The barrel plates 15 are pressed against the respective face plates 7 by means of springs 18 which are mounted in holes in the shaft 2. The compression chambers 11 communicate via a central through-hole having a diameter D1 (FIG. 2) in the respective sleeve bottoms 12 with cooperating passages 19 in the barrel plates 15. The passages 19 in the barrel plates 15 communicate via passages in the face plates 7 with a high-pressure port and a low-pressure port (not shown) in the housing 27.

FIG. 2 shows that in this embodiment the piston 9 is fixed to the flange 8 by means of a piston pin 20 which is pressed into a flange hole. A slot-shaped cavity 21 is present between the piston pin 20 and the inner side of the circumferential wall of the piston head 14. This means that under operating conditions hydraulic fluid can enter the cavity 21 and exert a force onto the circumferential wall of the piston head 14 in order to deform the piston head 14. Since the hydraulic load on the outer side of the piston head 14 is not rotation symmetrical the piston head 14 has an oval shape during a compression phase.

FIG. 1 shows that the pistons 9 in the upper side of the drawing are in top dead center and the pistons 9 in the lower side of the drawing are in bottom dead center. FIG. 2 shows that the piston 9 is in top dead center. It can be seen that due to the inclined orientation of the piston 9 within the sleeve 10, the sealing line is located at a distance D2 (FIG. 1) from the sleeve bottom 12. In practice this distance is smaller than 30% of the distance D3 (FIG. 1) between the sleeve bottom 12 and the sealing line at bottom dead center in case of a hydraulic device having a fixed displacement. In case of a hydraulic device having a variable displacement the mentioned distance is applicable when the angle between the first axis of rotation 4 and the second axis of rotation is maximal. The largest angle may be 10° in practice. The distance between the sealing line at top dead center and bottom dead center is dictated by the orientation of the supporting surface of the face plate 7 with respect to the flange 8 and the distance between the piston 9 and the first axis of rotation 4.

Figure 3:
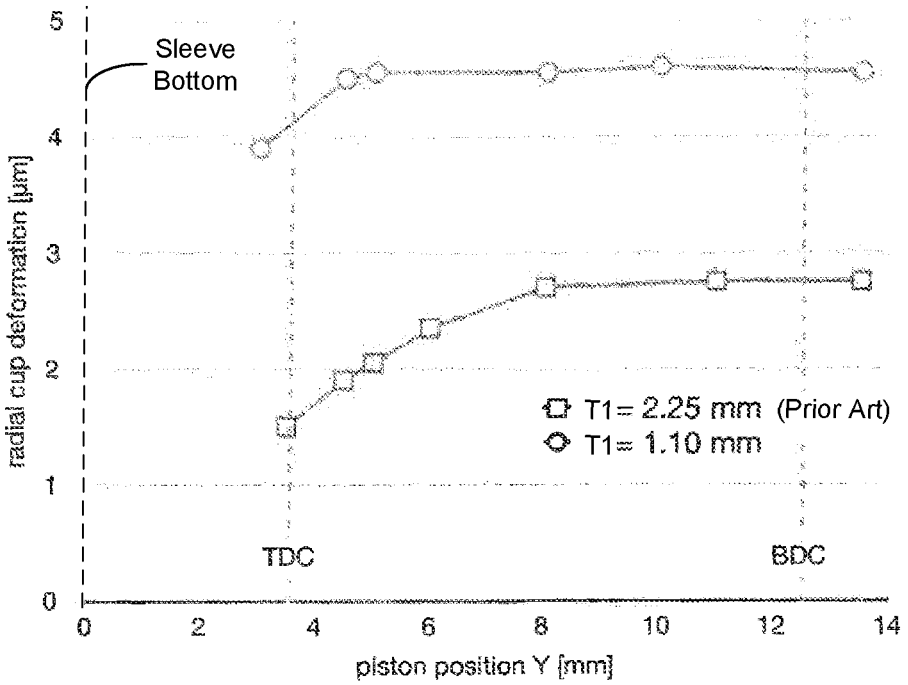
FIG. 3 is a diagram of a simulation result of radial deformation of a sleeve jacket at a fixed pressure.

In the embodiment as shown in FIG. 2 the sleeve jacket 13 has a very thin wall, which has a thickness T1 of less than 1.5 mm, for example. In some embodiments, the wall thickness T1 of the sleeve jacket is smaller than a maximum thickness T2 of the circumferential wall of the piston head 14, as shown in FIG. 2. This appears to have a surprisingly advantageous effect on the functioning of the hydraulic device 1, which is illustrated by means of simulation results as depicted in FIG. 3. Calculations of radial deformation of the sleeve jacket 13 have been performed at different locations of the piston 9 within the sleeve 10 at a pressure of 500 bar, once for a sleeve jacket 13 having a wall thickness T1 of 2.25 mm in accordance with conventional sleeve jackets, and once for a sleeve jacket 13 having a wall thickness T1 of 1.10 mm. The sleeve jackets 13 have an inner diameter D4 and an outer diameter D5. The diameter of the central through-hole may be larger than 70% of the inner diameter D4 of the sleeve jacket 13. The inner diameters D4 of both sleeve jackets 13 are 11.8 mm and the lengths D6 of the sleeves 10 are 15 mm. The sleeve bottom 12 of the sleeve 10 having the thickest side wall has a thickness T3 of 1.5 mm and its central through-hole has a diameter of 7.5 mm. The sleeve bottom 12 of the sleeve 10 having the thinnest side wall has a thickness of 0.5 mm and a diameter D1 of the central through-hole is 9.5 mm. The thickness T3 of the sleeve bottom 12 may be smaller than 60% of the wall thickness T1 of the sleeve jacket 13. The radial deformation is calculated at the sealing line. FIG. 3 shows that for both wall thicknesses the radial deformation as seen from bottom dead center BDC to top dead center TDC remains substantially constant before it decreases upon approaching TDC. The sleeve jacket 13 having a thinner wall shows a larger absolute deformation than the sleeve jacket 13 having a thicker wall. It is also clear that the radial deformation reduces when the piston 9 and the sleeve bottom 12 approach each other since the stiffness of the sleeve jacket 13 increases due to the presence of the sleeve bottom 12.

An essential difference between the sleeve jackets 13 having different wall thicknesses is that the length along which the radial deformation remains substantially constant as measured from bottom dead center is relatively long for the sleeve jacket 13 having the thinnest wall. The radial deformation reaches its constant value at 8 mm from the sleeve bottom 12, whereas in case of the thin sleeve jacket the deformation reaches its constant value already at 5 mm from the sleeve bottom 12.

Due to the thin wall of the sleeve jacket 13 in the embodiment as shown in FIG. 2 deformation of the sleeve jacket 13 is in fact decoupled from the sleeve bottom 12 to a certain extent. A similar effect is achieved by alternative embodiments of sleeves.

Figure 4:
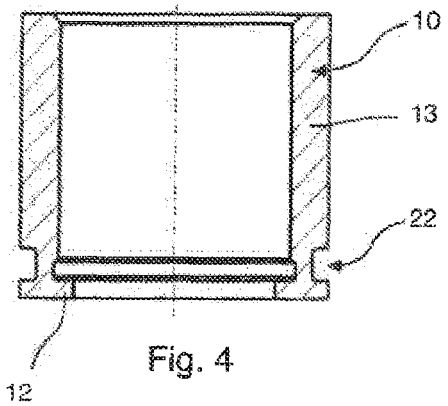
FIGS. 4 and 5 are cross-sectional views of alternative embodiments of sleeves.
Figure 5:
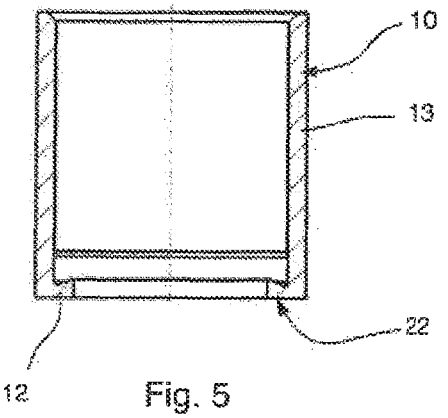

FIGS. 4 and 5 show alternative embodiments of sleeves 10. Each of the sleeves 10 has a locally reduced wall thickness 22 at the transition between the sleeve-jacket 13 and the sleeve bottom 12. In the embodiment of FIG. 4 the locally reduced wall thickness 22 is located in the sleeve jacket 13 and formed by opposite circumferential recesses or grooves located at the inner side and outer side of the sleeve jacket 13. In the embodiment of FIG. 5 the locally reduced wall thickness 22 is located in the sleeve bottom 12 and formed by a circumferential recess located at the inner side of the sleeve 10. Due to the presence of the locally reduced wall thicknesses 22 the sleeve jacket 13 is elastically movable with respect to the sleeve bottom 12.

From the foregoing it can be concluded that due to the thin wall of the sleeve jacket and/or elastically movability of the sleeve jacket with respect to the sleeve bottom, the sleeve jacket deformation of the sleeve jacket is not affected by the sleeve bottom or affected by the sleeve bottom to a limited extent.

The invention is not limited to the embodiment shown in the drawings and described hereinbefore, which may be varied in different manners within the scope of the claims and their technical equivalents.

The invention claimed is:

1. A hydraulic device comprising a housing, a shaft which is mounted in the housing and rotatable about a first axis of rotation, wherein the shaft has a flange extending transversely to the first axis, a plurality of pistons which are fixed to the flange at equiangular distance about the first axis of rotation, a plurality of cylindrical sleeves including sleeve bottoms and sleeve jackets, respectively, and cooperating with the pistons to form respective compression chambers of variable volume, wherein the cylindrical sleeves are rotatable about a second axis of rotation which intersects the first axis of rotation by an acute angle such that upon rotating the shaft the volumes of the compression chambers change between bottom dead center and top dead center of the pistons within the cylindrical sleeves, wherein each piston has a piston head including a circumferential wall of which an outer side is ball-shaped, hence forming a sealing line within the cooperating sleeve jacket, and an inner side surrounds a cavity, each sleeve jacket has such a thin wall and/or is elastically movable with respect to the sleeve bottom such that at an elevated fixed pressure in the compression chamber at which radial deformation of the sleeve jacket occurs, radial deformation of the sleeve jacket at the sealing line is substantially constant at piston positions ranging from bottom dead center to a position where a distance between the sleeve bottom and the sealing line is less than 50% of the distance between the sleeve bottom and the sealing line at bottom dead center.

2. The hydraulic device according to claim 1, wherein the radial deformation is substantially constant to a position where the distance between the sleeve bottom and the sealing line is less than 40% of the distance between the sleeve bottom and the sealing line at bottom dead center.

3. The hydraulic device according to claim 1, wherein the cylindrical sleeve is made of steel and a wall thickness of the sleeve jacket is smaller than 1.5 mm.

4. The hydraulic device according to claim 1, wherein a wall thickness of the sleeve jacket is smaller than a maximum thickness of the circumferential wall of the piston head.

5. The hydraulic device according to claim 1, wherein a thickness of the sleeve bottom is smaller than 60% of a wall thickness of the sleeve jacket.

6. The hydraulic device according to claim 1, wherein the sleeve bottom has a central through-hole through which the compression chamber communicates with a cooperating passages in a barrel plate which supports the cylindrical sleeve, wherein a diameter of the central through-hole is larger than 70% of an inner diameter of the sleeve jacket.

7. The hydraulic device according to claim 1, wherein a wall thickness of the sleeve jacket is smaller than 13% of an outer diameter of the sleeve jacket.

8. The hydraulic device according to claim 1, wherein the cylindrical sleeve has a locally reduced wall thickness at a transition between the sleeve jacket and the sleeve bottom.

9. The hydraulic device according to claim 8, wherein the locally reduced wall thickness is located in the sleeve jacket.

10. The hydraulic device according to claim 9, wherein the locally reduced wall thickness is formed by opposite circumferential recesses located at an inner side and an outer side of the sleeve jacket.

11. The hydraulic device according to claim 8, wherein the locally reduced wall thickness is located in the sleeve bottom.

12. The hydraulic device according to claim 11, wherein the locally reduced wall thickness is formed by a circumferential recess located at the inner side of the cylindrical sleeve.

13. The hydraulic device according to claim 1, wherein a wall thickness of the sleeve jacket is smaller than 13% of a length of the sleeve jacket.

14. The hydraulic device according to claim 1, wherein the wall thickness of the sleeve jacket is smaller than 13% of an outer diameter of the sleeve jacket and smaller than 13% of a length of the sleeve jacket.

15. The hydraulic device according to claim 1 wherein the elevated fixed pressure is 500 bar.

* * * * *